US007309209B2

(12) United States Patent
Amiot et al.

(10) Patent No.: US 7,309,209 B2
(45) Date of Patent: Dec. 18, 2007

(54) DEVICE FOR TUNING CLEARANCE IN A GAS TURBINE, WHILE BALANCING AIR FLOWS

(75) Inventors: Denis Amiot, Dammarie les Lys (FR); Anne-Marie Arraitz, Nandy (FR); Thierry Fachat, Moissy Cramayel (FR); Alain Gendraud, Vernou la Celle S/Seine (FR); Delphine Roussin, Antony (FR)

(73) Assignee: Snecma Moteurs, Paris (FR)

( * ) Notice: Subject to any disclaimer, the term of this patent is extended or adjusted under 35 U.S.C. 154(b) by 463 days.

(21) Appl. No.: 11/072,534

(22) Filed: Mar. 7, 2005

(65) Prior Publication Data

US 2007/0264120 A1 Nov. 15, 2007

(30) Foreign Application Priority Data

Mar. 18, 2004 (FR) ..... 04 02826

(51) Int. Cl.
*F03B 11/00* (2006.01)
*F03D 11/00* (2006.01)

(52) U.S. Cl. ..... 415/173.2; 415/136; 415/175; 415/178

(58) Field of Classification Search ..... 415/115, 415/136, 173.2, 175, 178
See application file for complete search history.

(56) References Cited

U.S. PATENT DOCUMENTS 4,849,895 A * 7/1989 Kervistin ..... 415/178
5,100,291 A 3/1992 Glover
6,149,074 A * 11/2000 Friedel et al. ..... 415/175
6,896,038 B2 * 5/2005 Arilla et al. ..... 415/115

FOREIGN PATENT DOCUMENTS

| | | |
|---|---|---|
| EP | 0 492 865 A1 | 7/1992 |
| EP | 0 541 325 A1 | 5/1993 |
| EP | 0 892 152 A1 | 1/1999 |
| EP | 0 892 153 A1 | 1/1999 |
| EP | 1 205 637 A1 | 5/2002 |
| FR | 2 652 858 | 4/1991 |

* cited by examiner

*Primary Examiner*—Igor Kershteyn
(74) *Attorney, Agent, or Firm*—Oblon, Spivak, McClelland, Maier & Neustadt, P.C.

(57) ABSTRACT

A device for tuning clearance at rotor blade tips in a gas turbine rotor, the device comprising at least one annular air flow duct that is mounted around the circumference of an annular casing of a stator of the turbine, the annular air flow duct being designed to discharge air onto the casing in order to modify the temperature thereof. A tubular air manifold is disposed around the air flow duct(s). There are also disposed an air feed tube to supply the tubular air manifold with air and an air pipe opening in the tubular air manifold and opening out into the air flow duct(s). The air pipe is provided with a balancing diaphragm for balancing the air flowing through the pipe.

6 Claims, 2 Drawing Sheets

DEVICE FOR TUNING CLEARANCE IN A GAS TURBINE, WHILE BALANCING AIR FLOWS

BACKGROUND OF THE INVENTION

The present invention relates to the general field of tuning clearance at rotor blade tips in a gas turbine. More specifically, the invention provides a tuning device for a high-pressure turbine of a turbomachine, which device is equipped with means for balancing air flows.

A gas turbine, such as a high-pressure turbine of a turbomachine, includes a plurality of rotor blades that are disposed in the passage for the hot gas that comes from a combustion chamber. Around the entire circumference of the turbine, the rotor blades of the turbine are encompassed by an annular stator. Said stator defines one of the walls for the stream of hot gas flowing through the turbine.

In order to increase the efficiency of the turbine, it is known to minimize the clearance between the turbine rotor blade tips and the facing portions of the stator.

In order to do so, clearance tuning means have been designed for tuning clearance at the blade tips. Generally, said means come in the form of annular pipes which surround the stator and which convey air that is drawn from other portions of the turbomachine. Depending on the operating speed of the turbine, the air is injected onto the outer surface of the stator in order to modify its temperature, thereby causing thermal expansion or contraction capable of varying the diameter of said stator.

Existing tuning devices do not always enable highly uniform temperature to be obtained around the entire circumference of the stator. A lack of temperature uniformity generates distortions in the stator which are particularly detrimental to the efficiency and the lifetime of the gas turbine.

OBJECT AND SUMMARY OF THE INVENTION

The present invention thus aims to mitigate such drawbacks by proposing a device for tuning clearance in a gas turbine that makes it possible to balance the air flows in the tuning device in order to reduce temperature non-uniformities around the stator in the turbine.

To this end, the invention provides a clearance tuning device for tuning clearance at rotor blade tips in a gas turbine rotor, comprising: at least one annular air flow duct that is mounted around the circumference of an annular casing of a stator of the turbine, said annular air flow duct being designed to discharge air onto said casing in order to modify the temperature thereof; a tubular air manifold at least a portion of which is disposed around the air flow duct(s); at least one air feed tube for feeding the tubular air manifold with air; and at least one air pipe opening in the tubular air manifold and opening out into the air flow duct(s); wherein the air pipe is provided with means for balancing the air flowing through said pipe.

Preferably, the means for balancing the air flow passing through the air pipe consists of a diaphragm that is disposed at the entrance of the air pipe, for example.

Thus, by balancing the air flow passing through the air pipe it is possible to reduce temperature non-uniformities in the vicinity of the turbine casing. It is possible to determine head losses (in the air feed to the air flow duct(s)) in such a manner as to balance the air flows, so it is also possible to determine the characteristics required of the diaphragm.

Advantageously, the diaphragm is disposed at an entrance of the air pipe so as to create additional head losses. Said diaphragm may come in the form of a ring having an inside diameter that is smaller than the inside diameter of the air pipe.

When the device includes two tubular air manifolds, each manifold being connected to three air pipes, each air pipe opening out into three air flow ducts, each air pipe is advantageously provided with a balancing diaphragm for balancing the air flow going through said pipe. In which case, and preferably, the characteristics of each diaphragm are individualized to match the air pipe in which said diaphragm is placed.

BRIEF DESCRIPTION OF THE DRAWINGS

Other characteristics and advantages of the present invention appear in the description below, with reference to the accompanying drawings which show a non-limiting embodiment. In the figures.

DETAILED DESCRIPTION OF AN EMBODIMENT

Figure 1:
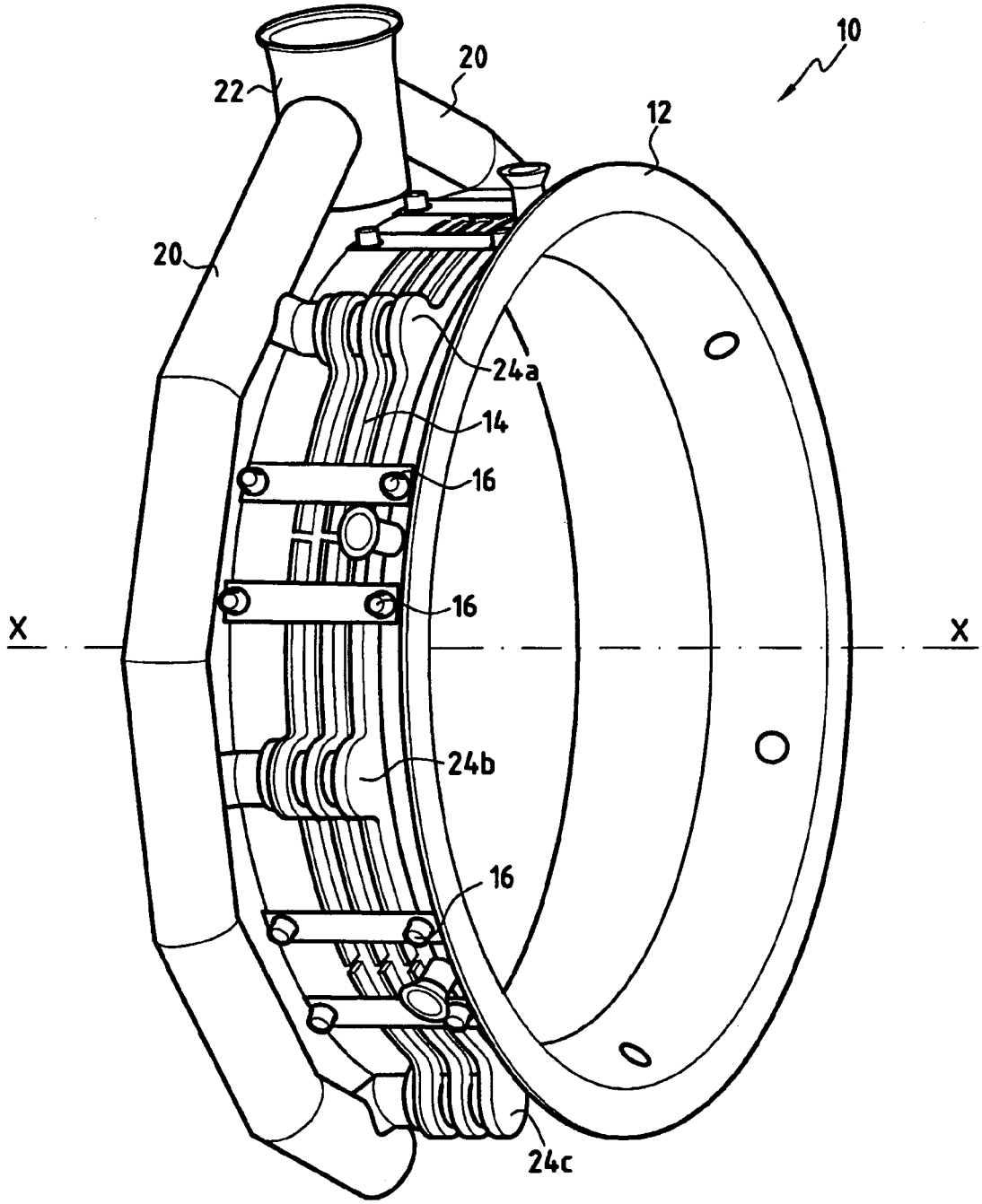
FIG. 1 is a perspective view of a tuning device in accordance with the invention.
Figure 2:
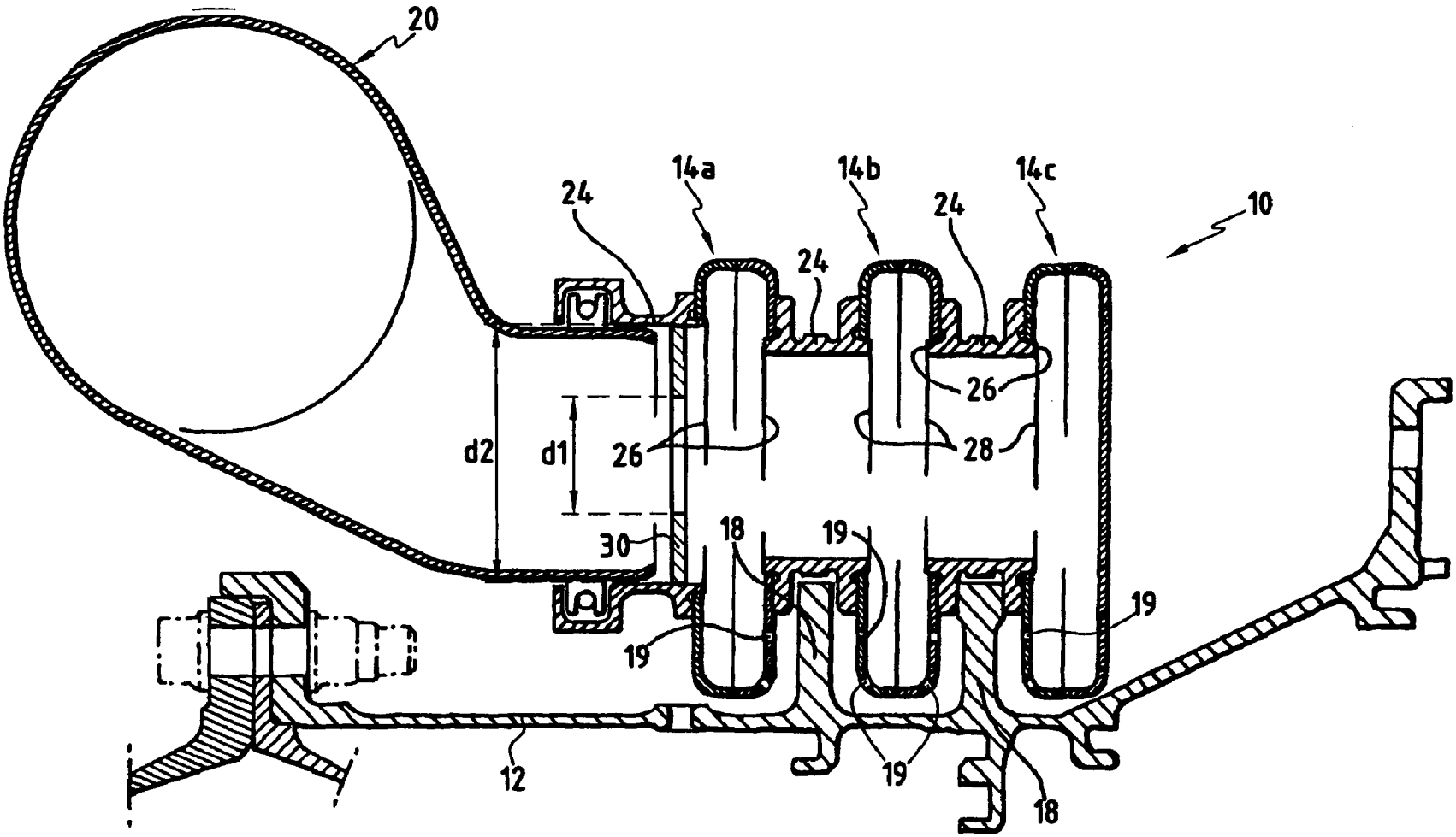
FIG. 2 shows the location of the balancing means for balancing air flows in the device in FIG. 1.

FIGS. 1 and 2 show a tuning device 10 in accordance with the invention. Such a tuning device can be applied to any gas turbine that needs clearance control at its rotor blade tips. Most particularly, said device is applicable to a high-pressure turbine of a turbomachine.

In the figures, the tuning device 10 is mounted on an annular casing 12 that is part of the turbine stator. Said casing 12 of longitudinal axis X-X encompasses a plurality of rotor blades (not shown) that make up the turbine rotor.

The tuning device 10 serves to control the clearance that exists between the tips of the rotor blades of the turbine and the facing portions of the stator.

The turbine rotor blades are encompassed by a plurality of ring segments (not shown) that are mounted on the casing 12 via spacers (not shown). Thus, the portions of the stator that face the rotor blade tips are made up of the inner surfaces of the ring segments.

The tuning device 10 in FIGS. 1 and 2 consists of three air flow ducts 14: an inner duct 14*a*, a central duct 14*b*, and an outer duct 14*c*. Said ducts are mounted around the circumference of the outer surface of the casing 12 via fastening rods. It would also be possible to have a single air flow duct.

The air flow ducts 14 are axially spaced apart from one another and are substantially parallel to one another. Said ducts are disposed on either side of two annular ridges (or projections) 18 that extend radially outwards from the casing 12.

The ducts 14 are provided with a plurality of holes 19 that are disposed facing the outer surface of the casing 12 and of the ridges 18. Said holes 19 enable the air flowing in the ducts 14 to be discharged onto the casing 12, thereby modifying the temperature thereof.

Moreover, as shown in FIG. 1, the air flow ducts 14 can be split up into a plurality of distinct angular duct sectors (in FIG. 1, there are six) that can be distributed evenly around the entire circumference of the casing 12.

In addition, the tuning device 10 includes at least one tubular air manifold 20 that encompasses at least a portion of the air flow ducts 14. In FIG. 1, two tubular air manifolds 20 are provided. The tubular air manifold(s) is/are designed to feed the air flow ducts 14 with air.

Each tubular air manifold 20 is fed with air by at least one air feed tube 22. The air feed tube 22 is connected to zones in the turbomachine from which air can be drawn in order to feed the tuning device 10. By way of example, the air-feed zones may be one or more stages in a compressor of the turbomachine.

The amount of air drawn from the zones in the turbomachine that are provided for this purpose can be regulated by a control valve (not shown) that is interposed between said air-feed zones and the air feed tube 22. Such a valve serves to control the tuning device 10 as a function of the operating speed of the turbine.

The tuning device 10 also has at least one air pipe 24 opening in the tubular air manifold and opening out into the air flow ducts 14 in order to feed said ducts with air.

In FIG. 1, one air pipe 24 is provided per air flow duct angular sector i.e. the tuning device has six air pipes 24 that are evenly distributed around the entire circumference of the casing 12.

Since the tuning device 10 in FIG. 1 includes an air feed tube 22 that feeds two different tubular air manifolds 20, each tubular air manifold 20 extends around about half of the circumference, thereby feeding three air pipes 24. Said air pipes 24 are distinguished from one another by being named, respectively: first air pipe 24*a*, for the pipe that is the closest to the air feed tube 22, second air pipe 24*b*, for the pipe that is placed directly downstream from the first pipe 24*a*, and third air pipe 24*c* for the pipe that is the furthest away from the air feed tube 22.

Each air pipe 24 comes in the form of a cylinder, made, for example, of metal, having edges 26 that become engaged in the side openings 28 of the air flow ducts 14. The air pipes 24 are thus welded to the ducts 14.

According to the invention, at least one of the air pipes 24 is provided with means for balancing the air conveyed by said pipe.

Advantageously, such means come in the form of a diaphragm 30 that is disposed at the entrance of the air pipe 24, i.e. upstream from the air flow ducts 14 relative to the flow direction of the air flowing from the tubular air manifold 20. More specifically, the diaphragm 30 is placed upstream from the inner duct 14*a*.

The presence of said diaphragm 30 in at least one air pipe 24 and, preferably, in each air pipe 24*a*, 24*b*, and 24*c* serves to balance the air coming from the tubular air manifold 20 and feeding the air flow ducts 14 into which the air pipe opens out.

In FIG. 2, the diaphragm 30 comes in the form of a ring (or washer) that is made of metal and, for example, that is welded to the inner walls of the air pipe 24, said ring having an inside diameter d1, representing the air flow section, that is smaller than the inside diameter d2 of the air pipe 24.

The characteristics of the balancing diaphragm 30 for balancing the air flow (such as its inside diameter d1 relative to the inside diameter d2 of the air pipe 24) are determined in such a manner as to generate additional head losses at the entrance of each air pipe 24 that is fed by said diaphragm. In fact, since the head losses are not identical for each air pipe 24 that is fed from a single tubular air manifold 20, the characteristics of the diaphragms 30 are modeled so as to generate additional head losses at the entrance of each air pipe 24 in such a manner as to obtain a balanced distribution of air flows.

The method used to model the characteristics of the diaphragms that are required for each of the air pipes 24 is described below, which method is based on modeling the air flows in a tuning device of the prior art.

With reference to a tuning device of the prior art (i.e. not provided with balancing means for balancing air flows), Table 1 below shows the distribution of air flows in three air pipes 24*a*, 24*b*, 24*c* fed by a single tubular air manifold 20, and in each air flow duct 14 of a single duct sector fed by each of said air pipes. These air flows were modeled on the basis of a turbomachine having a high-pressure turbine that is equipped with a clearance tuning device and operating at cruising speed.

| | |
|---|---|
| Flow in the first air pipe 24a (grams per second: g/s) | 32.43 |
| Flow in the inner duct 14a (g/s) | 4.11 |
| Flow in the central duct 14b (g/s) | 7.76 |
| Flow in the outer duct 14c (g/s) | 4.35 |
| Flow in the second air pipe 24b (g/s) | 34.03 |
| Flow in the inner duct 14a (g/s) | 4.31 |
| Flow in the central duct 14b (g/s) | 8.16 |
| Flow in the outer duct 14c (g/s) | 4.54 |
| Flow in the third air pipe 24c (g/s) | 34.42 |
| Flow in the inner duct 14a (g/s) | 4.36 |
| Flow in the central duct 14b (g/s) | 8.26 |
| Flow in the outer duct 14c (g/s) | 4.59 |

With reference to Table 1, the results of ventilation highlight the fact that the air flows are distributed in an non-uniform manner, firstly at the entrance of each air pipe 24*a*, 24*b* and 24*c* (which comes to 6%), and secondly between each sector of air flow ducts (which comes to 5.8%). The third air pipe 24*c* shows higher air feed pressure than the other two pipes 24*a*, 24*b* owing to reducing the speed at which the air in the tubular air manifold flows. As a result of the non-uniform manner in which the air flows in each of the air pipes, the casing is not cooled in a uniform manner. Thus, temperature gradients can arise, thereby causing mechanical distortions.

On the basis of these results, it is possible to model the additional head losses which should be applied to each air pipe 24 in order to obtain uniform distribution of the air flows. Hence, simulation of the additional head losses makes it possible to calculate the characteristics of the diaphragms 30 (in particular, their inside diameter d1 relative to the inside diameter d2 of each air pipe 24).

By way of example, based on the data modeled in Table I, it is observed that for the second air pipe 24*b*, it is necessary to generate an additional head loss of about 3.8. In order to generate such a head loss, it is necessary to install a diaphragm having a hole section F1 that serves to ensure that F1/F2=0.51, where F1 is the hole section or air flow section of the diaphragm and where F2 is the air flow section of the air pipe 24*b*. For an air pipe 24*b* diameter d2 of about 39.8 millimeters (mm), the diameter d1 of the diaphragm 30 to be installed at the entrance of the second air pipe 24*b* is then about 28.4 mm.

Still on the basis of the data modeled in Table I, it is observed that for the third air pipe 24*c*, it is necessary to generate an additional head loss of about 4.5. As described above, such a head loss can be obtained with a diaphragm having a hole section F1 that serves to ensure that F1/F2=0.49, where F1 is the hole section or air flow section of the diaphragm and where F2 is the air flow section of the air pipe 24*c*. For an air pipe 24*c* diameter d2 of about 39.8 mm, the diameter d1 of the diaphragm 30 to be installed at the entrance of the second air pipe 24*c* is then of about 27.9 mm.

The characteristics of each diaphragm 30 installed in each air pipe 24 that are determined on the basis of the simulation of the additional head losses that need to be generated, are individualized for each air pipe. The results of installing the diaphragms are outlined in Table II below.

| | |
|---|---|
| Flow in the first air pipe 24a (grams per second: g/s) | 32.59 |
| Flow in the inner duct 14a (g/s) | 4.14 |
| Flow in the central duct 14b (g/s) | 7.82 |
| Flow in the outer duct 14c (g/s) | 4.37 |
| Flow in the second air pipe 24b (g/s) | 32.67 |
| Flow in the inner duct 14a (g/s) | 4.12 |
| Flow in the central duct 14b (g/s) | 7.78 |
| Flow in the outer duct 14c (g/s) | 4.35 |
| Flow in the third air pipe 24c (g/s) | 32.52 |
| Flow in the inner duct 14a (g/s) | 4.13 |
| Flow in the central duct 14b (g/s) | 7.79 |
| Flow in the outer duct 14c (g/s) | 4.36 |

In Table II, it is observed that due to installing diaphragms in the air pipes 24*a*, 24*b*, and 24*c*, the air flow is distributed more uniformly between the air pipes, with departures from uniformity of 1%, which is a negligible. As a result, the temperature of the casing 12 is uniform.

Therefore, it is possible to balance the air flowing in each angular sector of the air flow ducts 14 by adding an individualized balancing diaphragm for balancing the air flows at the entrance of the air pipe which opens out into said duct angular sector.

In other words, it is possible to balance the air flows individually for each sector of the air flow ducts 14 by adapting the section of the diaphragm depending on the requirements of a specific duct section. Hence, it is possible to provide each air pipe 24 with a diaphragm 30 having characteristics (air flow section) that differ from one duct sector to another duct sector.

What is claimed is:

1. A device for tuning clearance at rotor blade tips in a gas turbine rotor, comprising:

at least one annular air flow duct that is mounted around the circumference of an annular casing of a stator of the turbine, said annular air flow duct being designed to discharge air onto said casing in order to modify the temperature thereof;

a tubular air manifold, at least a portion of which is disposed around the air flow duct(s);

at least one air feed tube for feeding the tubular air manifold with air; and at least one air pipe opening in the tubular air manifold and opening out into the air flow duct(s);

wherein the air pipe is provided with means for balancing the air flowing through said pipe.

2. A device according to claim 1, wherein the air pipe is provided with a balancing diaphragm for balancing the air flowing through said pipe.

3. A device according to claim 2, wherein the diaphragm is disposed at an entrance of the air pipe so as to create additional head losses.

4. A device according to claim 3, wherein the diaphragm comes in the form of a ring having an inside diameter d1 that is smaller than the inside diameter d2 of the air pipe.

5. A device according to claim 1, including two tubular air manifolds, each manifold being connected to three air pipe, each air pipe opening out into three air flow ducts, each air pipe being provided with a balancing diaphragm for balancing the air flow going through said pipe.

6. A device according to claim 5, wherein the characteristics of each diaphragm are individualized to match the air pipe in which said diaphragm is placed.

* * * * *